US006481982B1

(12) United States Patent
Yokomichi

(10) Patent No.: US 6,481,982 B1
(45) Date of Patent: Nov. 19, 2002

(54) DIAPHRAGM PUMP HAVING A MECHANISM FOR PREVENTING THE BREAKAGE OF THE DIAPHRAGM WHEN A DISCHARGE CHECK VALVE IS NOT COMPLETELY CLOSED DUE TO THE INSERTION OF FOREIGN MATTER INTO THE VALVE

(75) Inventor: Manabu Yokomichi, Higashimurayama (JP)

(73) Assignee: Nikkiso Company Limited, Tokyo (JP)

( * ) Notice: Subject to any disclaimer, the term of this patent is extended or adjusted under 35 U.S.C. 154(b) by 0 days.

(21) Appl. No.: 09/622,363

(22) PCT Filed: Feb. 17, 1999

(86) PCT No.: PCT/JP99/00685

§ 371 (c)(1),
(2), (4) Date: Aug. 16, 2000

(87) PCT Pub. No.: WO99/41502

PCT Pub. Date: Aug. 19, 1999

(30) Foreign Application Priority Data

Feb. 17, 1998 (JP) ..... 10-034690

(51) Int. Cl.[7] ..... F04B 43/06

(52) U.S. Cl. ..... 417/395; 417/394; 251/61; 251/30.01

(58) Field of Search ..... 417/394, 395, 417/386, 387, 388; 251/30.01, 61

(56) References Cited

U.S. PATENT DOCUMENTS 4,430,048 A * 2/1984 Fritsch ..... 417/383
4,465,438 A * 8/1984 Brauer et al. ..... 417/386
4,865,528 A * 9/1989 Fritsch et al. ..... 417/388
5,246,351 A * 9/1993 Horn et al. ..... 417/387
5,248,351 A 9/1993 Horn et al.

FOREIGN PATENT DOCUMENTS

| | | |
|---|---|---|
| JP | 60 81486 | 5/1985 |
| JP | 5 240162 | 9/1993 |
| JP | 5 321841 | 12/1993 |
| JP | 6 93976 | 4/1994 |
| JP | 7 77165 | 3/1995 |
| JP | 7 259741 | 10/1995 |

* cited by examiner

*Primary Examiner*—Charles G. Freay
*Assistant Examiner*—W Rodriguez
(74) *Attorney, Agent, or Firm*—Browdy and Neimark, P.L.L.C.

(57) ABSTRACT

A diaphragm pump, in which a working fluid control valve (D) opens a working fluid make-up passage (B24) to prevent a diaphragm (C) from being damaged when an excessive discharge pressure acts on the diaphragm. The working fluid control valve (D) for opening and closing the working fluid make-up passage (B24) is provided with a valve disc formed to be capable of reciprocating relative to the diaphragm (C) in a valve disc receiving chamber (B2) to close an opening of the valve disc receiving chamber (B2), means for biasing the valve disc toward the diaphragm, and means for closing the working fluid make-up passage (B24) when a distance, over which the valve disc extends from the opening of the valve disc receiving chamber, exceeds a predetermined value.

14 Claims, 4 Drawing Sheets

DIAPHRAGM PUMP HAVING A MECHANISM FOR PREVENTING THE BREAKAGE OF THE DIAPHRAGM WHEN A DISCHARGE CHECK VALVE IS NOT COMPLETELY CLOSED DUE TO THE INSERTION OF FOREIGN MATTER INTO THE VALVE

CROSS REFERENCE TO RELATED APPLICATION

The present application is the national stage under 35 U.S.C. 371 of PCT/JP99/00685, filed Feb. 17, 1999.

TECHNICAL FIELD

The present invention relates to a diaphragm pump and, more particularly, to a diaphragm pump in which the breakage of the diaphragm, which is caused by over-supply of working fluid due to a negative pressure created through the suction stroke of the diaphragm pump as well as an excessive discharge pressure exerted to the diaphragm, can be prevented.

BACKGROUND ART

In the field of diaphragm pumps, it is a commonly known technique to provide an air-discharge valve for outwardly discharging the gas separated by vacuum from the diaphragm-driving working fluid and the gas generated due to cavitation in the working fluid.

However, when such gas is discharged through the air-discharging valve, a small amount of the working fluid is also discharged from the pump. Also, a small quantity of the working fluid leaks through the packing.

In the field of diaphragm pump, therefore, it has been common to provide a cavity in the wall surface of a working fluid chamber filled with working fluid so that the cavity is opposed to the diaphragm, and to install in the cavity a working fluid control valve operative to automatically supply the pump with the working fluid to compensate for the leakage thereof.

The conventionally used working fluid control valve has a columnar valve member resiliently biased toward the diaphragm. The columnar valve member has a side surface provided with a communication port formed therein. The working fluid control valve also has a guide member so disposed in the cavity as to extend toward the diaphragm in the working fluid chamber. The valve member is slidably interconnected with the guide member, having therein a working fluid supply port.

However, in a piping system where more than two diaphragm pumps are connected in parallel, if foreign matters flowing through the piping system adhere to the discharge valve of one diaphragm pump or if a valve member of the discharge valve is scratched or worn, the discharge valve cannot completely be closed. This may result in a possibility that the discharge pressure of another or the other pump is imparted through the incompletely closed discharge valve to the diaphragm of the one of the pumps whereby the diaphragm is strongly urged against a wall surface of the working liquid chamber. Such a phenomenon is liable to occur particularly when the operation of one of double diaphragm pumps or triple diaphragm pumps is stopped while the other pump or pumps are still in operation.

In the working fluid control valve of the conventional diaphragm pump, the surface of the valve member opposed to the diaphragm is more recessed than the peripheral edge of the opening of the cavity. In addition, a gap is formed between the outer periphery of the forward end of the valve member and the inner peripheral surface of the cavity. Thus, when the diaphragm is strongly urged against the wall surface of the working liquid chamber, the diaphragm is liable to be damaged by the nonalignment formed between the forward end face of the valve member and the peripheral edge of the opening of the cavity, or by the gap formed between the inner peripheral surface of the cavity and the outer peripheral surface of the valve member.

The present invention has an object of providing a diaphragm pump in which the working fluid is not excessively supplied due to a negative pressure created through the suction stroke of the pump, and which diaphragm pump is not damaged even when an unduly strong force is exerted thereto, unlike a diaphragm pump provided with the conventional working fluid control valve.

DISCLOSURE OF INVENTION

The present invention provides a diaphragm pump which comprises a pumping chamber having a wall formed by a diaphragm reciprocatingly movable to suck and discharge a liquid to be processed into and out of said pumping chamber, a working fluid chamber separated by said diaphragm from said pumping chamber and containing a working fluid for transmitting a pressure change, said working fluid chamber having a wall surface disposed facing said diaphragm, a cavity having an opening formed in said wall surface of said working fluid chamber, diaphragm driving means operative to impart a cyclic pressure fluctuation to the working fluid in said working fluid chamber to thereby reciprocate said diaphragm, a working fluid vessel containing said working fluid, a working fluid supply passage communicating with said working fluid chamber through said cavity, and a working fluid control valve for closing and opening said working fluid supply passage, said working fluid control valve comprising:

- a valve member reciprocatingly movable in front of said diaphragm and operative to close the opening of said cavity;
- means for biasing said valve member so as to project said valve member out of the opening of said cavity;
- working fluid supply passage opening/shutting means for opening said working fluid supply passage when said valve member is positioned close to the opening of said cavity and for closing said working fluid supply passage when said valve member projects from the opening of said cavity; and
- means for limiting the maximum distance over which a valve head of said valve member projects from the opening of said cavity.

In one preferred embodiment of the invention, said valve member has a surface disposed facing said diaphragm and so shaped that, when said valve member closes the opening of said cavity, said surface is aligned and continuous with said wall surface of said working fluid chamber.

In another preferred embodiment of the invention, said working fluid control valve has a guide member for guiding the reciprocating movement of said valve member.

In a still another preferred embodiment of the invention, said guide member is a columnar member extending from the bottom of said cavity toward said diaphragm.

In a further embodiment of the invention, the biasing means is disposed between the inner wall surface of said cavity and said valve member.

In a still further embodiment of the invention, said biasing means is disposed between said valve member and said guide member.

In a specific embodiment of the invention, said biasing means comprises a coil spring.

BEST MODE FOR CARRYING-OUT THE INVENTION

1. An Example of the Diaphragm Pump of the Present Invention

An example of the diaphragm pump in accordance with the present invention will be described hereunder with reference to the drawings.

Figure 1:
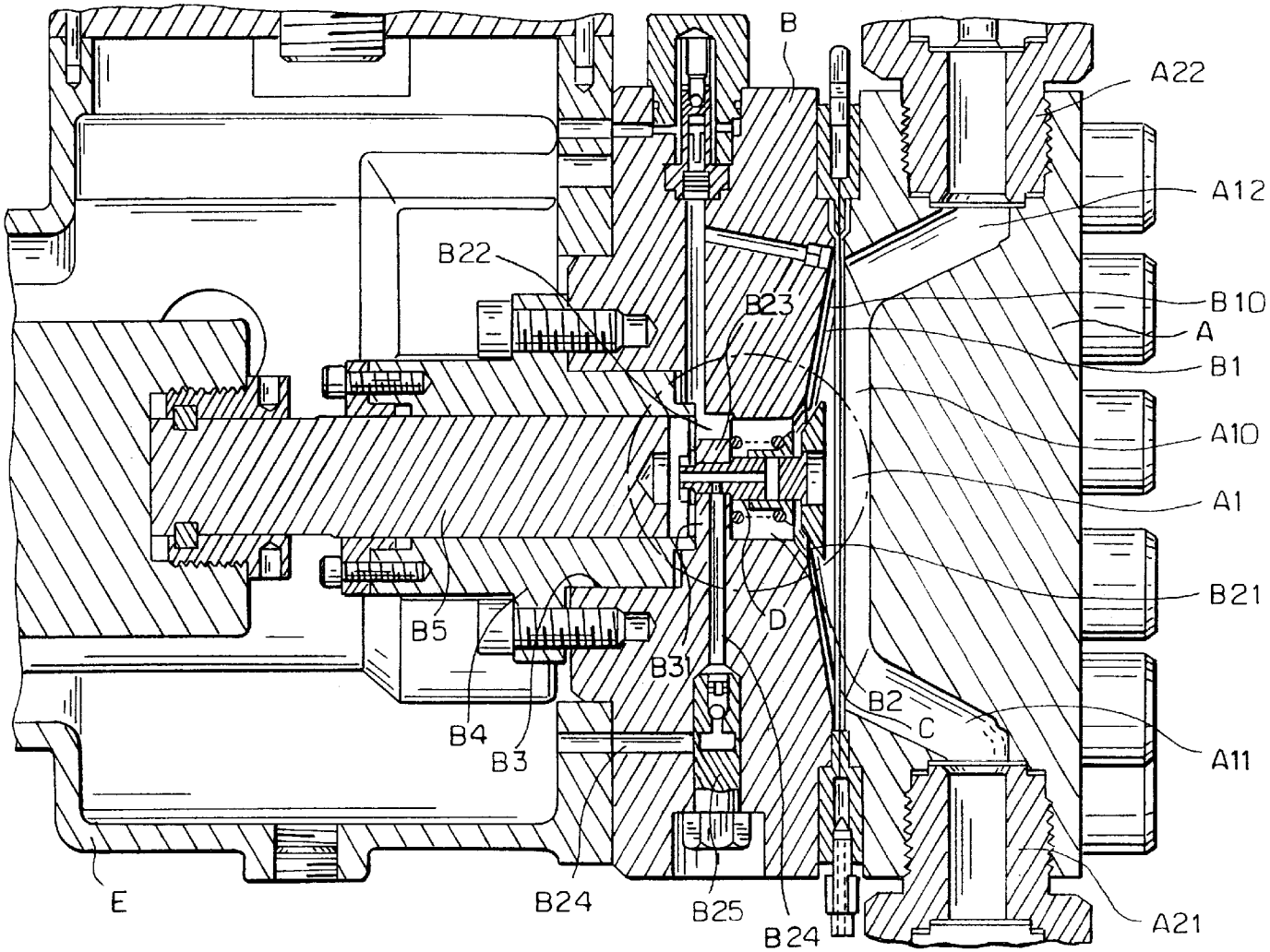
FIG. 1 is a longitudinal sectional view of an example of the diaphragm pump of the present invention.

The example of the diaphragm pump of the present invention is shown in FIG. 1 of the drawings.

The diaphragm pump shown in FIG. 1 is provided with a generally circular pump head A having a first cavity A10 formed in a first surface of the head, diaphragm C which closes the first cavity A10 in pump head A, and disk-shaped pump base B having a diameter the same as that of pump head A and being fixed, with bolts, to pump head A, with diaphragm C sandwiched therebetween.

The first cavity A10 and diaphragm C cooperate to define pumping chamber A1 in pump head A. Pump head A is provided therein with suction passage A11 through which a fluid to be processed is sucked into pumping chamber A1, and discharge passage A12 through which the fluid is discharged from pumping chamber A1. The suction and discharge passages A11 and A12 are respectively provided with suction valve A21 and discharge valve A22, both of which are check valves.

Pump base B is provided therein with a conical second cavity B10 which faces the first cavity A10 with diaphragm C interposed therebetween. The second cavity B10 and diaphragm C cooperate to define working oil chamber B1. The bottom of working oil chamber B1 is provided therein with a generally cylindrical third cavity B2 having a bottom face opposed to diaphragm C. The opening of the third cavity B2 has a peripheral edge which is beveled to provide conical valve seat B21.

In this embodiment, the working oil chamber corresponds to the working fluid chamber in the pump of the present invention.

Pump base B is further provided with a generally cylindrical fourth cavity B3 that is formed in the side of the pump base opposite to the side thereof, in which the third cavity B2 is formed. Partition wall B31 is formed between the third and fourth cavities B2 and B3. Cylinder B4 is disposed in the fourth cavity B3 and fixed to pump base B with bolts. Partition wall B31 is provided with communication port B22 and working oil control valve hole B23 to which working oil control valve D is fixed.

Piston B5 is disposed in cylinder B4 so as to be capable of moving reciprocatingly.

In this embodiment of the invention, cylinder B4 and piston B5 cooperate to form a diaphragm driving section of the pump in accordance with the invention.

Working oil chamber B1, the third cavity B2, communication port B22, the inner surfaces of the forth cavity B3 and of cylinder B4, and an end face of piston B5 cooperate together to define a space which is filled with a working fluid.

Working oil accumulation vessel E is fixed to the face of pump base B which is opposite to the face thereof to which diaphragm C and pump head A are fixed. Working oil accumulation vessel E is an example of the working fluid accumulation vessel of the pump in accordance with the present invention.

Working oil control valve D is disposed in the third cavity B2. This working oil control valve D is an example of the working fluid control valve in the present invention. One end of working oil control valve D is inserted into and fixed to working oil control valve hole B23 formed in partition wall B31.

Pump base B is provided with working oil supply port B24 which communicates working oil accumulation vessel E with working oil control valve hole B23. Working oil supply port B24 is provided with working oil supply valve B25, which is a check valve. The passage extending from working oil accumulation vessel E through working oil supply port B24 to working oil chamber B1 is an example of the working fluid supply passage in the pump of the present invention. Also, working oil supply valve B25 is an example of the working fluid control valve in the pump of the invention.

Figure 2:
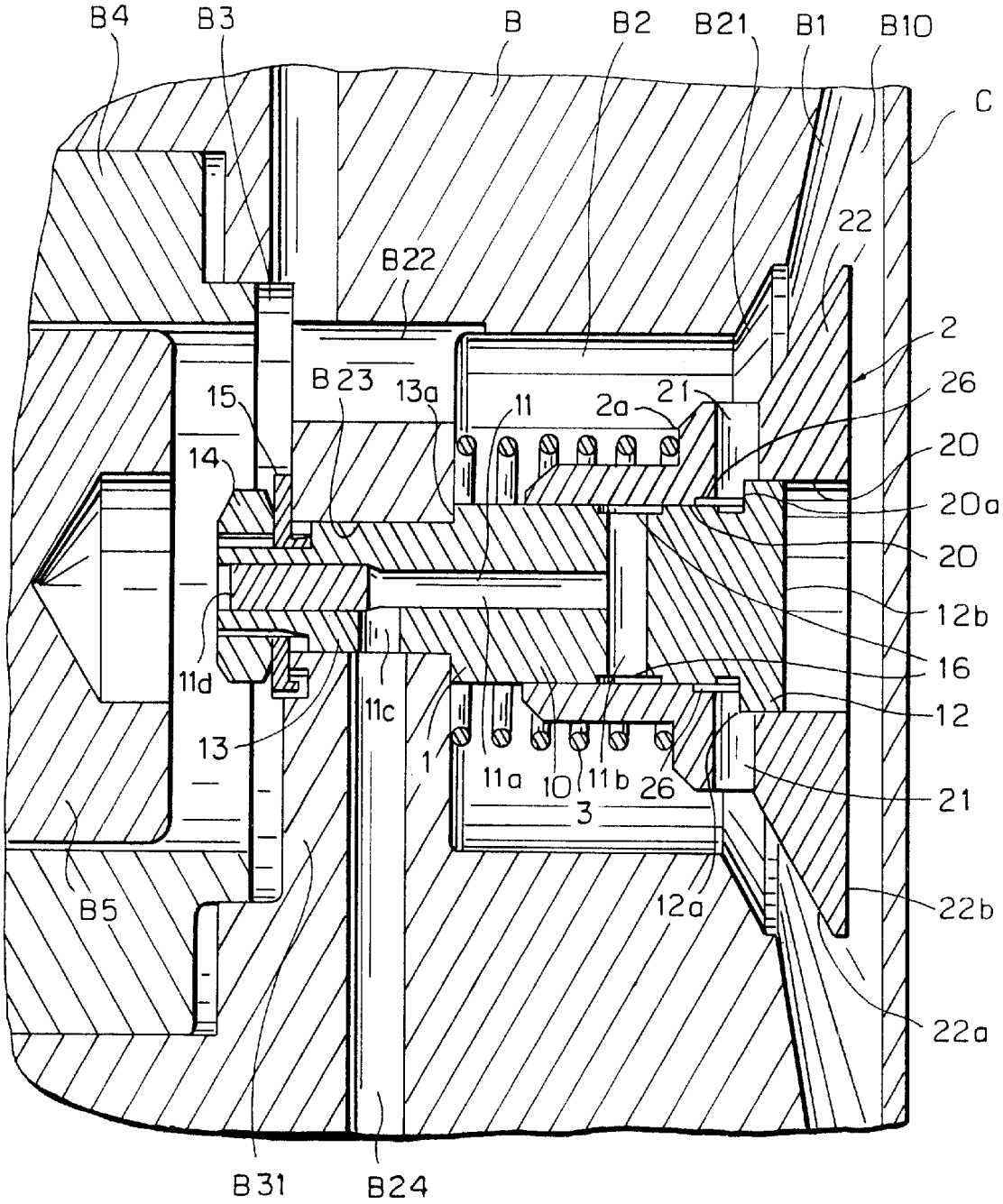
FIG. 2 is a longitudinal sectional view illustrating the structural details of the working oil control valve of the diaphragm pump shown in FIG. 1.

Structural details of working oil control valve D are shown in FIG. 2 of the drawings.

Working oil control valve D includes generally cylindrical guide member 1 disposed in the third cavity B2 and extending toward diaphragm C, valve member 2 slidably interconnected with the guide member 1 so as to close the opening of the third cavity B2, and coil spring 3 biasing valve member 2 toward diaphragm C. Coil spring 3 is an example of the biasing means in the pump of the invention.

Guide member 1 comprises generally columnar guide member body 10, stop 12 having a diameter greater than the diameter of the guide member body 10 and formed on that end thereof which faces diaphragm C, and fixing portion 13 formed on that end of guide member body 10 which faces piston B5, and inserted into working oil control valve hole B23.

Stop 12 has end face 12*b* that faces diaphragm C, the end face being normal to the axis of guide member 1 and coplanar with the plane which includes the peripheral edge of opening B21 of the third cavity B2. Opening B21 forms a valve seat.

Abutment 12*a* is formed between stop 12 and guide member body 10. This stop 12 is an example of the limiting means of the pump in accordance with the invention.

The outer diameter of fixing portion 13 is smaller than that of guide member body 10. Fixing portion 13 also has such an outer diameter that the fixing portion can fitly be received in working-oil control valve hole B23. Thus, abutment 13*a* is formed between guide member body 10 and fixing portion 13. Abutment 13*a* abuts on the bottom face of the third cavity B2, while an end of fixing portion 13 extends toward piston B5 from that surface of partition wall B31 which faces piston B5. Fixing nut 14 is threadably engaged with that end of the fixing portion. On guide member 1 between fixing nut 14 on fixing portion 13 and the surface of partition wall 31 facing piston B5, is provided fixing ring 15 to prevent guide member 1 from being rotated in working oil control valve hole B23.

Through guide member body 10, is channeled a generally T-shaped first communication port 11 communicating with working oil supply port B24.

The first communication port 11 comprises a first branch port 11*a* extending in guide member 1 parallel with the axis thereof and having an open end facing piston B5 and a closed end to diaphragm C, and a second branch port 11*b* crossing with the first branch port 11*a* at the closed end and being perpendicular to the axis. In fixing portion 13 is formed a third branch port 11*c* communicating the first branch port 11*a* with working oil supply port B24. Plug lid is threadably engaged with that part of the first branch port 11*a* which is closer to piston B5 than the third branch port.

On the side face of guide member 1, the opposite ends of the second branch port 11*b* are opened. In addition, a first communication groove 16 is formed around the cylindrical face of guide member body 10 and the width of the groove 16 extends from the open ends of the second branch port 11*b* toward stop 12.

Valve member 2 has guide member insertion hole 20 formed therein, into which guide member 1 is inserted. Guide member insertion hole 20 has an inner diameter capable of slidably receiving guide member body 10 therein. However, the open end of guide member insertion hole 20 facing diaphragm C and the open end-side part of the guide member insertion hole have an inner diameter which is capable of slidably receiving stop 12 therein. Abutment 20*a* is formed between that part of the inner surface wall forming guide member insertion hole 20 which slidably receives guide member body 10 and that part of the inner surface wall forming guide member insertion hole 20 which slidably receives stop 12.

Valve head 22 is formed on that end of valve body 2 which faces diaphragm C. Valve head 22 has an outer peripheral portion spreading outwardly toward diaphragm C and planar diaphragm-contacting surface 22*b* which is provided on the surface of the valve head opposed to diaphragm C and is normal to the axis of guide member 1. One end of guide member insertion hole 20 is opened in the central portion of diaphragm contacting surface 22*b*. On the side of the valve member opposite to diaphragm-contacting surface 22*b*, is formed conical surface 22*a* which is engaged with valve seat 21B when the valve is closed, i.e. when valve member 2 closes the opening of valve member accommodating chamber B2. When the valve is closed, diaphragm-contacting surface 22*b* is positioned in the same plane as end face 12*b* of the stop and cooperates therewith to define a bottom face of the conical wall face of the second cavity B10 which is working oil chamber B1. On the other hand, when the valve is opened, i.e. when valve member 2 does not close the opening of valve member accommodating chamber B2, diaphragm-contacting surface 22*b* is in a position closer to diaphragm C, parting from stop end face 12*b*. This configuration makes a gap between conical surface 22*a* and valve seat B21.

Valve member 2 has second communication ports 21 that extend inside valve member 2 in a perpendicular direction of the axis of guide member 1. One end of each of the second communication ports 21 opens at a part near valve head 22, on the side face of valve member 2. The other end opens on that inner wall face forming guide member insertion hole 20 which contacts with and slides on the outer side face of guide member body 10. Including the positions on the wall face where the other ends open, a second communication groove 26 is formed around the cylindrical face of the inner wall and the width of the groove 26 extends from the openings of the second communication port 21 toward partition wall B31. When the first communication groove 16 communicate with the second communication groove 26, the second communication ports 21 communicate with the second branch port 11*b*. Through the communication ports 21 and communication port 11, is connect the outer surface of valve member 2 with working oil supply valve B25 and working oil supply port B24. By this arrangement, the working oil is supplied to working oil chamber B1. In this embodiment of the invention, the first communication port 11, the first communication groove 16, the second communication port 21 and the second communication groove 26 cooperate to constitute working fluid supply passage opening/shutting means, as understood from the above.

Abutment 2*a* for receiving coil spring 3 is formed in the outer side face of valve member 2 at a position closer to piston B5 than to the opening of the second communication port 21. The part of valve member 2 closer to piston 5 than abutment 2*a* has a diameter smaller than the diameter of coil spring 3 and is received therein.

The steps of operation of working oil control valve D in the diaphragm pump shown in FIGS. 1 and 2 are briefly illustrated in FIG. 3.

Figure 3A:
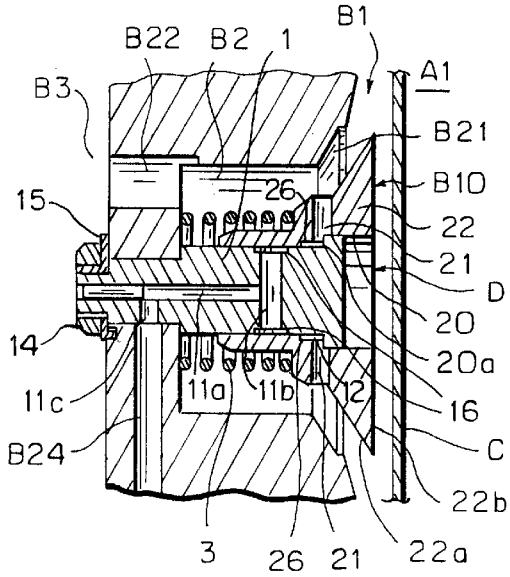
FIG. 3 roughly illustrates the movement of the diaphragm pump shown in FIGS. 1 and 2.

In an oil supply phase during the normal operating condition, valve member 2 of working oil control valve D is situated at a position closest to pumping-chamber A1, as shown in FIG. 3(A). In this position, abutment 20*a* of valve member 2 is engaged with abutment 12*a* of guide member 1, so that valve member 2 is prevented from being moved from the position shown in FIG. 3(A) into pumping-chamber A1. Because a gap is formed between conical surface 22*a* of valve head 22 and valve seat B21 in the third cavity B2, the periodic pressure fluctuation caused in the fourth cavity B3 due to the reciprocating movement of piston B5 (not shown) in cylinder B4 is transmitted through communication port B22 and the third cavity B2 to working oil chamber B1 to thereby reciprocatingly move diaphragm C. On the other hand, because the first communication groove 16 is not communication with the second communication groove 26, the first communication port 11 does not communicate with the second communication port 21. This means that working oil supply valve B25 and working oil supply port B24 are not in communication with the third cavity B2. Consequently, no working oil is supplied from working oil vessel E into working oil chamber B1.

At this time, if the quantity of the working oil in working oil chamber B1 is reduced due to leakage of the working oil from working oil chamber B1 for some reason, diaphragm C is bulged toward working oil control valve D and into contact with diaphragm-contacting surface 22*b* of valve head 22. Diaphragm C then urges valve member 2 toward the bottom of the third cavity B2 to a position in which the first communication groove 16 communicates with the second communication groove 26. This position is shown in FIG. 3(B).

Figure 3B:
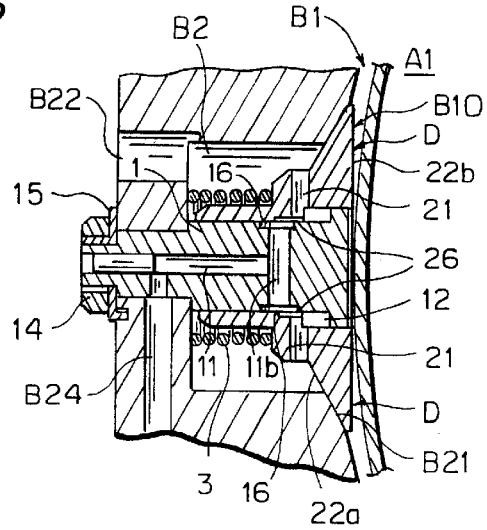

In the configuration shown in FIG. 3(B), since the first communication groove 16 is in communication with the second communication groove 26 and the second branch port 11*b* of the first communication port 11 is in communication with the second communication ports 21, working oil supply port B24 is in communication with the first communication port 11 and the second communication ports 21. On the other hand, because a gap still exists between conical surface 22*a* of valve head 22 and valve seat B21 in the third cavity B2, the third cavity B2 and working oil chamber B1 are still in communication with each other. Thus, working oil supply port B24 is in communication with working oil chamber B1 through the first communication port 11, the second communication port 21 and the third cavity B2. In addition, since piston B5 (not shown) is situated in its bottom dead center, the third cavity B2 and working oil chamber B1 are both in their reduced-pressure conditions. Consequently, the working oil contained in working oil accumulation vessel E is sucked into working oil chamber B1 through working oil supply port B24, the first communication port 11, the second communication ports 21 and the third cavity B2. As the working oil is sucked into working oil chamber B1, the position of diaphragm C is bulged toward pumping chamber A1. At this time, because valve member 2 is biased by coil spring 3 toward diaphragm C, the position of valve member 2 is shifted toward pumping chamber A1 as diaphragm C is bulged toward pumping chamber A1. This configuration interrupts the communication between the first communication port 11 with the second communication port 21. Then, the working oil supply passage formed by working oil supply port B24, the first communication port 11, the second communication port 21 and the third cavity B2 is closed, with the result that the supply of the working oil into working oil chamber B1 is finished.

Figure 3C:
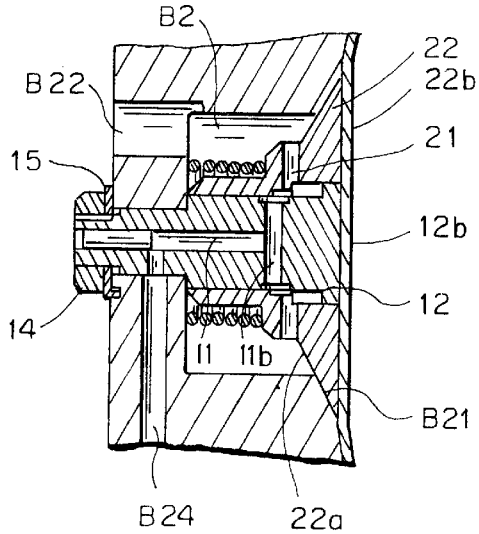

If occurs a condition in which discharge check valve A22 is not completely closed because of, for example, insertion of foreign matters into the valve, the discharge pressure of another pump may be introduced into the pumping chamber through the incompletely closed discharge check valve A22. In such a situation, the pressure level in pumping chamber A1 may unduly be increased to urge diaphragm C against the wall surface of working oil chamber B1 and diaphragm-contacting surface 22*b* of valve head 22, as shown in FIG. 3(C). Thus, valve member 2 is urged toward the bottom of the third cavity B2 until conical surface 22*a* of valve head 22 is engaged with valve seat B21, the opening of the third cavity B2 is closed by valve member 2. The working oil supply passage is now closed, so that the working oil is not supplied into working oil chamber B1, with the result that working oil chamber B1 is prevented from being subjected to unduly elevated pressure.

In the described situation, because the discharge pressure described above is imparted to diaphragm-contacting surface 22*b* of valve head 22, valve member 2 is urged to more reliably close the opening of the third cavity B2. Moreover, diaphragm-contacting surface 22*b* of valve head 22 and stop end face 12*b* of guide member 1 are positioned in the same plane and cooperate to form a bottom face of the bowl-shaped wall surface of working oil chamber B1. This arrangement keeps diaphragm C from being damaged by the nonaligned boundaries between valve member 2 and the peripheral edge of the opening of the third cavity B2, between diaphragm-contacting surface 22*b* and stop end face 12*b*, and between diaphragm-contacting surface 22*b* and the third cavity B3, when diaphragm C is urged onto diaphragm-contacting surface 22*b* by the discharge pressure.

2. Example 2

Figure 4:
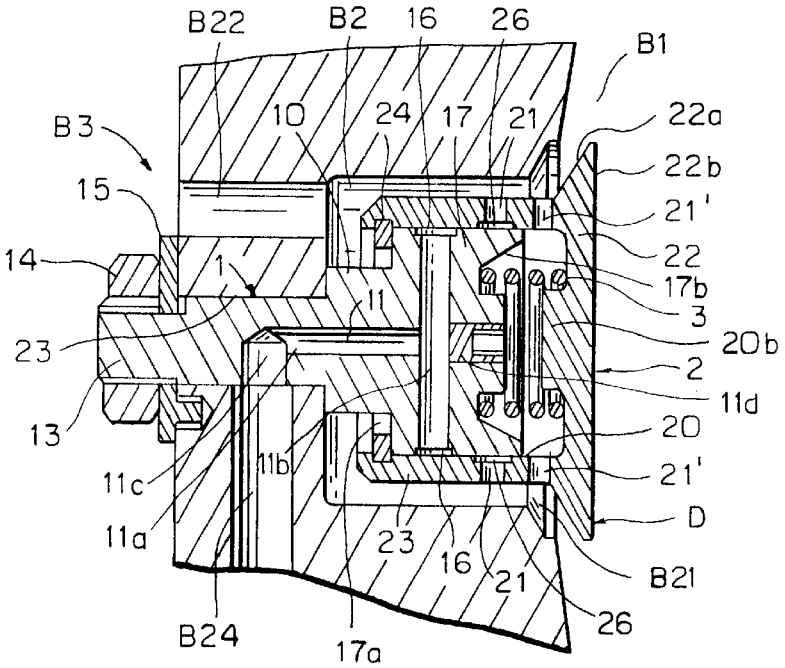
FIG. 4 is a longitudinal sectional view of an example of the working fluid control valve which utilizes a columnar guide member and a valve member, only one end of which is opened to provide a space for receiving the guide member therein.

FIG. 4 shows the structure around the working oil control valve of the diaphragm pump of the example 2 in accordance with the present invention. It is noted that, in FIG. 4, the same reference numerals as those used in FIGS. 1–3 denote the same or identical things as those in FIGS. 1–3 unless any particular exceptions are noticed. It is also noted that the diaphragm pump of the example 2 excepting working oil control valve D is the same in structure as the diaphragm pump of the example 1. In addition, as in the diaphragm pump of the example 1, working oil control valve D of the diaphragm pump of the example 2 is one of the working fluid control valves of the diaphragm pump according to the present invention.

As shown in FIG. 4, working oil control valve D of the diaphragm pump of the example 2 is provided with guide member 1 which comprises generally columnar guide member body 10, columnar valve member-engaging portion 17, and mounting portion 13. Columnar valve member-engaging portion 17 is formed on the diaphragm C-side end of guide member body 10, and the diameter thereof is larger than that of guide member body 10. Mounting portion 13 is formed on the piston B5-side end of guide member body 10 and inserted into working oil control valve mounting hole B23. Like guide member 1 of the diaphragm pump of the example 1, guide member 1 of the example being described extends from the bottom surface of valve member-receiving chamber B2 toward its opening.

In guide member 1, abutment 17*a* is formed between valve member-engaging portion 17 and valve member body 10. On the other hand, circular spring-receiving groove 17*b* is formed in the diaphragm C-side end face of valve member-engaging portion 17.

Guide member 1 has a first communication port 11 inside thereof. This communication port 11 comprises a first bottomed branch port 11*a* formed by drilling in guide member 1 along the axis thereof and extending from the end face of valve member-engaging portion 17 toward mounting portion 13, a second branch port 11*b* formed inside of and extending through valve member-engaging portion 17 in the radial direction thereof and intersecting the first branch port 11*a* at right angles, and a third branch port 11*c* intersecting the bottom end portion of the first branch port 11*a* at right angles, communication port 11 communicating at the third branch port 11*c* with working oil supply port B24. The opening of the first branch port 11*a*, namely, the diaphragm C-side end thereof is closed by plug 11*d* threadably inserted thereinto. The second branch port 11*b* has open ends which are widened by a first communication groove 16.

Valve member 2 is slidably mounted on and surrounds valve member-engaging portion 17 of guide member 1. Valve member 2 comprises generally cylindrical valve member body 23 and valve head 22 formed on the diaphragm C-side end of valve member body 23. Valve head 22 is of a generally truncated conical shape that has the outside diameters gradually increasing toward diaphragm C. Valve head 22 has planar diaphragm-contacting surface 22*b* formed on the diaphragm C-side end face of the valve head and being normal to the axis of guide member 1.

Cylindrical guide member-insertion hole 20 is formed inside of valve member body 23. Guide member insertion hole 20 has an inside diameter substantially the same as the outside diameter of valve member-engaging portion 17.

A second communication port 21 has its ends opening on the side face of valve member body 23 to connect the side face with valve member-insertion hole 20. Working oil flowing port 21' is formed in the valve member between the second communication port 21 and valve head 22 to prevent the working oil from staying in the space defined by valve member-engaging portion 17, valve member body 23 and valve head 22. The ends of the second communication port 21 opening to the valve member-insertion hole are widened by a second communication groove 26. The second communication port 21, the second groove 26, the first communication port 11 and the first communication groove 16 cooperate together to constitute opening/shutting means. This means is one example the working fluid supply passage opening/shutting means of the working fluid control valve of the diaphragm pump according to the present invention. The surface of valve head 22 facing spring-receiving groove 17*b* forms the bottom face of valve member-insertion hole 20. Coil spring 3, which is the biasing means provided in the working fluid control valve of the diaphragm pump of the present invention, is disposed so as to extend between valve head 22 and valve member-engaging portion 17 of guide member 1. Generally cylindrical spring-receiving projection 20*b* having an outside diameter substantially the same as the inside diameter of coil spring 3 is formed in a central zone of the bottom face of guide member-insertion hole 20. One end of coil spring 3 is received on and engaged with the outside face of spring-receiving projection 20*b*, while the other end is fitly received in spring-receiving groove 17*b* in valve member engaging portion 17.

Restricting ring 24 is mounted on about the end, which faces the bottom of valve member-receiving chamber B2, of the inside wall of valve member body 23. In the position shown in FIG. 4, restricting ring 24 is engaged with abutment 17*a* on guide member 1 to prevent valve member 2 from being moved from the position shown in FIG. 4 toward diaphragm C. Thus, restricting ring 24 is valve-restricting means for restricting valve member 2 from being moved beyond a predetermined position toward diaphragm C.

As in working oil control valve D shown in FIGS. 1–3, valve member 2 of working oil control valve D shown in FIG. 4 projects from valve member-receiving chamber B2 to the maximum extent when the diaphragm pump is in its normal operating condition. At this time, the second communication port 21 is out of communication with the first communication port 11, so that the working oil accumulated in the working oil accumulation vessel (not shown) is not supplied into working oil chamber B1.

On the other hand, if the quantity of the working oil in working oil chamber B1 is decreased, the diaphragm (not shown) is bulged from its normal position toward working oil control valve D. Thus, the diaphragm (not shown) contacts with working oil control valve D and urges valve member 2 toward the bottom face of valve member-accommodating chamber B2, which makes the first communication groove 16 communicate with the second communication groove 26. Then, the working oil accumulated in the working oil accumulation vessel (not shown) is supplied therefrom to working oil chamber B1 through working oil supply port B24, the first communication port 11 and the second communication port 21. When the working oil is supplied into working oil chamber B1, diaphragm C returns to the pumping chamber (not shown) and, therefore, working oil control valve D also resumes its position shown in FIG. 4, which finishes the supply of the working oil into the working oil chamber.

If unduly high pressure is imparted to the pumping chamber (not shown), the diaphragm (not shown) is strongly urged against working oil control valve D to a position in which valve head 22 is pushed into the opening of the valve member-receiving chamber. Thus, valve member-accommodating chamber B2 is closed by valve member 2. This means that the working oil is not supplied into working oil chamber B1.

In working oil control valve D shown in FIG. 4, because valve member-engaging portion 17 of guide member 1 is surrounded by valve member 2, there is no possibility that the diaphragm C-side end face of guide member 1 contacts the diaphragm. Thus, the diaphragm C-side end face of guide member 1 needs not to be precisely finished. Consequently, working oil control valve D can be machined more easily than working oil control valve D of the example 1 shown in FIGS. 1–3. In addition, since the faces are aligned around diaphragm-contacting surface 22*b* of valve head 2, regardless of the position of valve member 2, is further decreased damage to the diaphragm which might be caused when an unduly high pressure is imparted to the pumping chamber, for example, the discharge pressure of another pump is exerted to the pumping chamber.

3. Example 3

A diaphragm pump of the example 3 is such a diaphragm pump as shown in FIG. 1 wherein working oil control valve D has valve member 2 which is guided by the side wall surface of valve member-accommodating chamber B2.

Figure 5:
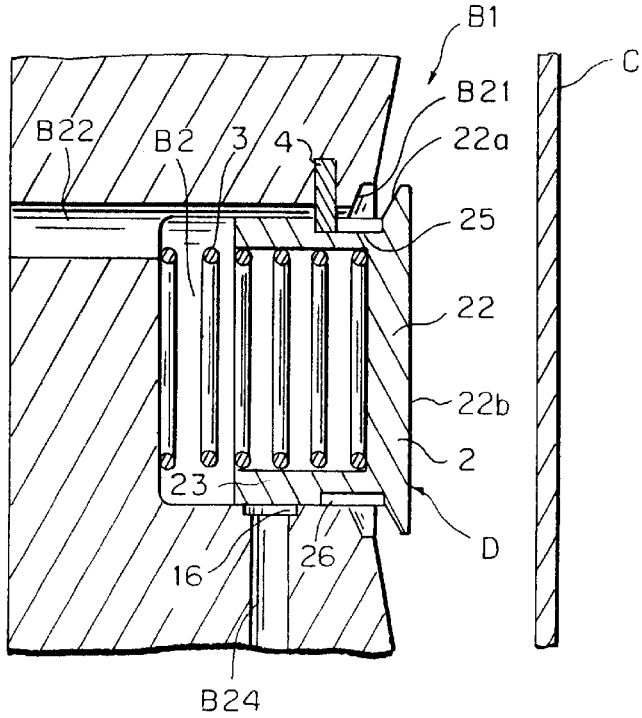
FIG. 5 is a longitudinal sectional view of another example of the working fluid control valve which comprises a valve member mounted in a cavity so as to be able to move reciprocatingly, biasing means for biasing the valve member toward a diaphragm, working fluid switching means for closing and opening a working fluid supply passage, and limiting means for limiting the maximum distance over which the valve member can project from the opening of the cavity.

The structural details of working oil control valve D of the diaphragm pump of the example 3 are shown in FIG. 5. In this figure, unless any particular exceptions are noticed, the reference numerals the same as those used in FIGS. 1–3 designate the parts and members equivalent to or the same as those shown in FIGS. 1–3.

As shown in FIG. 5, working oil supply port 24 opens in a central portion of a side face of valve member-accommodating chamber B2 and pin 4 is provided to project into valve member-accommodating chamber B2 close to its opening. A first communication groove 16 is provided around the opening of working oil supply port B24 to enlarge the opening.

Valve member 2 is of a generally cylindrical shape, and has valve member body 23 slidably engaged with valve member-accommodating chamber B2 and valve head 22 formed on the diaphragm C-side end of valve member body 23. Valve head 22 has diaphragm-contacting surface 22*b* which is formed on the diaphragm C-side of the valve head and provided with a planar surface intersecting with the axis of valve member body 23 at right angles, and conical surface 22*a* formed on the side of the valve head opposite to diaphragm-contacting surface 22*b* and widening toward diaphragm C. This conical surface is adapted to be engaged with valve seat B21 when valve member-accommodating chamber B2 is closed.

Valve member body 23 has a side face having, formed therein, a second communication groove 26 and guide groove 25. The second communication groove 26 extends, parallel with the axis of valve member body 23, from that end of valve member body 23 which is adjacent to conical surface 22*a* toward the end of the valve member body remote from valve head 22. Guide groove 25 is formed on the side face of valve member body 23 opposite to the second communication groove 26, putting the central axis of valve member body 23 therebetween, and extends in a parallel direction of the second communication groove 26. The second communication groove 26 is of such a length that the groove becomes in communication with working oil supply port B24 when valve head 22 is situated close to or in engagement with valve seat B21 and that the groove 26 is out of communication with working oil supply port B24 when valve member 2 projects to the maximum extent from valve member-accommodating chamber B2, as shown in FIG. 5. The second communication groove 26 and the first communication groove 16 in valve member-accommodating chamber B2 cooperate to form working fluid supply passage opening/shutting means of the working fluid control valve provided in the diaphragm pump of the present invention. Pin 4 is engaged with guide groove 25 to thereby control the range of the sliding movement of valve member 2. Thus, guide groove 25 and pin 4 cooperate to function as valve member control means.

Coil spring 3, which is one example of the biasing means of the working fluid control valve provided in the diaphragm pump of the invention, is disposed between the bottom face of valve member-accommodating chamber B2 and that face of valve head 22 of valve member 2 which is opposed to the bottom face of valve member-accommodating chamber B2.

As in the working oil control valve shown in FIGS. 1–3, valve member 2 provided in the working oil control valve shown in FIG. 5 projects, to the maximum extent, from valve member-accommodating chamber B2 when diaphragm C is situated in the normal position. At this time, working oil supply port B24 is out of communication with the second communication groove 26. Thus, the working oil accumulated in working oil vessel E is never supplied therefrom to working oil chamber B1.

If the quantity of the working oil in working oil chamber B1 is decreased, the diaphragm is bulged closer to working oil control valve D from the normal position. Thus, diaphragm C contacts with working oil control valve D to urge valve member 2 toward the bottom of valve member-accommodating chamber B2. As a result, the second communication groove becomes in communication with the first communication groove 16 and, thus, working oil supply port B24 is in communication with working oil chamber B1 through the first communication groove 16 and the second communication groove 26. Consequently, the working oil accumulated in the working oil accumulation vessel (not shown) is supplied therefrom through working oil supply port B24, the first communication groove 16 and the second communication groove 26 into working oil chamber B1. As the working oil is supplied into working oil chamber B1, diaphragm C returns toward the pumping chamber (not shown) and resumes the normal position. Thus, working oil control valve D is returned to the position shown in FIG. 5, which finishes the supply of the working oil into the working oil chamber.

If an unduly high pressure is exerted to the pumping chamber (not shown), diaphragm C is strongly urged against working oil control valve D until valve head 22 is engaged with valve seat B21 of valve member-accommodating chamber B2 to close the same. Thus, no working oil is supplied into working oil chamber B1.

Compared with working oil control valves D of the diaphragm pumps of the examples 1 and 2, working oil control valve D shown in FIG. 5 does not necessitate any guide members which project from the bottom of valve member-accommodating chamber B2. Therefore, this working oil control valve D can be simpler in structure and thus more easily manufactured than the working oil control valves shown in FIGS. 1–4.

4. Supplementary Description

The working fluid utilized in the diaphragm pump according to the present invention may be any liquid that possesses a function of transmitting pressure fluctuation to the diaphragm. The working fluid may be not only the working oil used in the diaphragm pumps of the examples 1–3 but also a pressure medium, examples of which are water, glycols such as ethylene glycol and polypropylene glycol, polyglycols such as polyethylene glycol and polypropylene glycol, and glycerin.

The diaphragm driving means of the diaphragm pump of the present invention may be any device that possesses a function of imparting pressure fluctuation to the working fluid in the working fluid chamber to reciprocally drive the diaphragm. More particularly, the means should be a device that imparts cyclic pressure fluctuation to the diaphragm, such as the combination of cylinder B4 and piston B5 of the diaphragm pumps of the examples 1–3.

The working fluid control valve provided in the diaphragm pump of the present invention is not limited to a working fluid control valve having such a valve member as valve member 2 provided in the diaphragm pump of the examples 1–3, but may be any valve which is provided with a valve member so disposed in the valve member-accommodating chamber as to reciprocate in front of the diaphragm. The working fluid control valve may be a valve provided with a valve member having a shank and a guide member having a through-hole or bottomed hole for receiving the shank.

The biasing means provided in the working fluid control valve may be not only a cylindrical coil spring such as coil spring 3 of the diaphragm pumps of the examples 1–3, but also a conical coil spring, a leaf spring such as rectangular leaf spring, triangular leaf spring, or laminated spring, and a rubber spring such as compression rubber spring, shear rubber spring, or torsion rubber spring.

The working fluid supply passage opening/shutting means of the working fluid control valve is not limited only to the working oil supply passage switching means which is used in the diaphragm pumps of the examples 1 and 2, i.e. the means including the first communication port 11 in communication with working oil supply port 24 and the second communication port 21 formed in valve member 2. The means is not either limited to the working oil supply passage shutting means employed In the diaphragm pump of the example 3. which comprises the first communication groove 16 and the second communication groove 26. It may be of any valve that possesses a function of closing the working fluid supply passage when the extension length of the valve member from the opening of the valve member-accommodating chamber becomes greater than a predetermined value.

Industrial Applicability

In the diaphragm pump according to the present invention, when the quantity of the working fluid in the working fluid chamber is decreased for some reason, the valve member of the working fluid control valve is urged by the diaphragm into the valve member-accommodating chamber. This urging opens the working fluid supply passage, so that the working fluid is fed into the working fluid chamber. In the diaphragm pump of the present invention, thus, the opening-closing operation of the working fluid control valve does not rely on the negative pressure in the working fluid to thereby assure reliable supply of the working fluid.

In the case where more than two diaphragm pumps are connected in parallel and the discharge valve of the first diaphragm pump cannot be completely closed with a result that the discharge pressure of the other pump is exerted to the pumping chamber of the first diaphragm pump through the discharge valve thereof, unduly high pressure is exerted to the pumping chamber of the first diaphragm pump. In such case, however, the diaphragm pump according to the present invention can prevent the diaphragm from being damaged in its portion around the valve member, because nonalignment cannot be found between the valve member of the working fluid control valve and the opening of the valve member-accommodating chamber in the working fluid chamber.

In addition, when the working fluid control valve is opened, a flow-passage for the working fluid is formed between the opening of the valve member-accommodating chamber and the valve member of the working fluid control valve. In a diaphragm pump of the type in which the diaphragm driving means and the working fluid chamber communicate through the valve member-accommodating chamber, the working fluid can also smoothly flow between the diaphragm driving means and the working chamber. Thus, the diaphragm pump of the present invention provides a high responsiveness and can highly precisely control the rate of discharge.

What is claimed is:

1. A diaphragm pump comprising a pumping chamber having a wall formed by a diaphragm reciprocatingly movable to suck and discharge a liquid to be processed into and out of said pumping chamber;

a working fluid chamber separated by said diaphragm from said pumping chamber and containing a working fluid for transmitting a pressure change, said working fluid chamber having a wall disposed facing said diaphragm, said wall having a cavity with an opening formed in a surface of said wall, said cavity having a bottom face opposite said opening;

a diaphragm driving mechanism operative to impart cyclic pressure fluctuation to the working fluid in said working fluid chamber to thereby reciprocate said diaphragm;

a guidance member fixed onto said bottom face and projecting therefrom into said cavity;

a working fluid vessel containing said working fluid;

a working fluid supply passage connecting said working fluid vessel with said working fluid chamber via said cavity; and a working fluid control valve for closing and opening said working fluid supply passage, said working fluid control valve comprising:

a valve member around said guide member, said valve member being reciprocatingly movable along said guide member in front of said diaphragm and operative to close the opening of said cavity;

a mechanism for biasing said valve member so as to project said valve member out of the opening of said cavity;

a working fluid supply passage opening/shutting device for opening said working fluid supply passage when said valve member is positioned close to the opening of said cavity and for closing said working fluid supply passage when said valve member projects from the opening of said cavity; and a mechanism for limiting the maximum distance over which a valve head of said valve member projects from the opening of said cavity.

2. The diaphragm pump according to claim 1, wherein said guide member is a columnar member.

3. A diaphragm pump according to claim 2, wherein said biasing mechanism is disposed between an inner wall surface of said cavity and said valve member.

4. The diaphragm pump according to claim 2, wherein said working fluid supply passage passes through a central part of said guide member and has a first end and a second end; said first end communicates with said working fluid vessel and said second end with the cavity; and said working fluid supply passage opening/shutting means opens and closes said second end.

5. The diaphragm pump according to claim 4, wherein said second end opens at points on the outer peripheral face of said guide member, and a first communication groove is formed around the outer peripheral face and the width thereof extends from each of the points toward said diaphragm; and said valve member has a guide member insertion hole formed therein into which said guide member is inserted; a communication path having a first communication port and a second communication port, said first communication port opening at the periphery of said valve member so that said communication path communicates with said cavity, and said second communication port opening at a point on that inner periphery of said valve member which forms said guide member insertion hole; and a second communication groove is forme don and around the inner periphery of said valve member with a width extending from said port in the opposite direction of said diaphragm;

whereby said first communication groove communicates with said second communication groove so as to open said second end when said valve member is positioned close to the opening of said cavity, and said first communication groove discommunicates with said second communication groove so as to close said second end when said valve member projects from the opening of said cavity.

6. A diaphragm pump according to claim 1, wherein said biasing mechanism is disposed between an inner wall surface of said cavity and said valve member.

7. A diaphragm pump according to claim 1, wherein said valve member has a surface disposed facing said diaphragm and so shaped that, when said valve member closes the opening of said cavity, said surface is aligned and continuous with said wall surface of said working fluid chamber.

8. A diaphragm pump according to anyone of claim 1, wherein said biasing means comprises a coil spring.

9. A diaphragm pump comprising a pumping chamber having a wall formed by a diaphragm reciprocatingly movable to suck and discharge a liquid to be processed into and out of said pumping chamber, a working fluid chamber separated by said diaphragm from said pumping chamber and containing a working fluid for transmitting a pressure change, said working fluid chamber having a wall surface disposed facing said diaphragm, a cavity having an opening formed in said wall surface of said working fluid chamber, diaphragm driving means operative to impart cyclic pressure fluctuation to the working fluid in said working fluid chamber to thereby reciprocate said diaphragm, a working fluid vessel containing said working fluid, a working fluid supply passage communicating with said working fluid chamber through said cavity, a working fluid control valve for closing and opening said working fluid supply passage, said working fluid control valve comprising:

a valve member reciprocatingly movable in front of said diaphragm and operative to close the opening of said cavity;

a mechanism for biasing said valve member so as to project said valve member out of the opening of said cavity;

a working fluid supply passage opening/shutting device for opening said working fluid supply passage when said valve member is positioned close to the opening of said cavity and for closing said working fluid supply passage when said valve member projects from the opening of said cavity;

a mechanism for limiting the maximum distance over which a valve head of said valve member projects from the opening of said cavity, wherein said working fluid control valve has a guide member for guiding the reciprocating movement of said valve member, and wherein said biasing mechanism is disposed between said valve member and said guide member.

10. A diaphragm pump according to claim 9, wherein said biasing mechanism comprises a coil spring.

11. A diaphragm pump comprising:

a pumping chamber having a wall formed by a diaphragm reciprocating movable to suck and discharge a liquid to be processed into and out of said pumping chamber;

a working fluid chamber separated by said diaphragm from said pumping chamber and containing a working fluid for transmitting a pressure change, said working fluid chamber having a wall disposed facing said diaphragm, said wall having a cavity with an opening formed in a surface of said wall, said cavity having a bottom face opposite said opening, said cavity having an inner side wall with a pin projecting into said cavity;

a diaphragm driving mechanism operative to impart cyclic pressure fluctuation to the working fluid in said working fluid chamber to thereby reciprocate said diaphragm;

a working fluid vessel containing said working fluid;

a working fluid supply passage connecting said working fluid vessel with said working fluid chamber via said cavity; and a working fluid control valve for closing and opening said working fluid supply passage, said working fluid control valve comprising:

a valve member reciprocatingly movable in front of said diaphragm and operative to close the opening of said cavity, said valve member having a guide groove inscribed along the axis of said valve member on the side face thereof, so that said guide groove receives said pin;

a mechanism for biasing said valve member so as to project said valve member out of the opening of said cavity; and working fluid supply passage opening/shutting device for opening said working fluid supply passage when said valve member is positioned close to the opening of said cavity and for closing said working fluid supply passage when said valve member projects from the opening of said cavity, wherein said pin is engaged with said guide groove so as to control the range of the sliding movement of said valve member.

12. A diaphragm pump according to claim 11, wherein said valve member has a surface disposed facing said diaphragm and so shaped that, when said valve member closes the opening of said cavity, said surface is aligned and continuous with said wall surface of said working fluid chamber.

13. A diaphragm pump according to claim 11, wherein said biasing mechanism is disposed between an inner wall surface of said cavity and said valve member.

14. A diaphragm pump according to claim 11, wherein said biasing mechanism comprises a coil spring.

* * * * *